US010427016B1

(12) United States Patent
Richmond

(10) Patent No.: US 10,427,016 B1
(45) Date of Patent: Oct. 1, 2019

(54) GOLF CLUB TRACKING SYSTEM

(71) Applicant: Ray D. Richmond, Nashville, TN (US)

(72) Inventor: Ray D. Richmond, Nashville, TN (US)

( * ) Notice: Subject to any disclaimer, the term of this patent is extended or adjusted under 35 U.S.C. 154(b) by 0 days.

(21) Appl. No.: 15/822,077

(22) Filed: Nov. 24, 2017

Related U.S. Application Data

(60) Provisional application No. 62/426,267, filed on Nov. 24, 2016.

(51) Int. Cl.
*A63B 57/00* (2015.01)
*G08B 21/24* (2006.01)
*A63B 55/00* (2015.01)

(52) U.S. Cl.
CPC ..... *A63B 57/00* (2013.01); *G08B 21/24* (2013.01); *A63B 55/00* (2013.01); *A63B 2225/15* (2013.01); *A63B 2225/50* (2013.01)

(58) Field of Classification Search
None
See application file for complete search history.

(56) References Cited

U.S. PATENT DOCUMENTS 5,952,921 A * 9/1999 Donnelly ..... G08B 13/1427 340/568.6
6,057,762 A * 5/2000 Dusza ..... A63B 55/00 340/568.6
6,118,376 A * 9/2000 Regester ..... G08B 13/1427 340/522
6,366,205 B1 * 4/2002 Sutphen ..... G08B 21/0227 340/568.1
6,407,667 B1 6/2002 Jackson et al.
6,411,211 B1 * 6/2002 Boley ..... A63B 55/00 340/568.6
6,696,950 B2 * 2/2004 Adolphson ..... G08B 13/1427 206/315.3
6,967,563 B2 * 11/2005 Bormaster ..... G06K 7/0008 340/10.2
7,004,848 B2 2/2006 Konow
7,205,894 B1 * 4/2007 Savage ..... A63B 55/00 340/568.6
D708,284 S 7/2014 Litwin
9,248,353 B1 * 2/2016 Koenig ..... A63B 57/00
9,545,549 B2 * 1/2017 Soracco ..... A63B 71/0619
(Continued)

FOREIGN PATENT DOCUMENTS

WO WO2006053188 5/2006

*Primary Examiner* — Chico A Foxx
(74) *Attorney, Agent, or Firm* — Matthew M. Googe; Robinson IP Law, PLLC

(57) ABSTRACT

A golf club tracking system for tracking the removal and replacement of golf clubs relative to a golf bag by a golfer includes: one or more golf club tags associated with one or more of the golf clubs; a golfer tag associated with the golfer; a base detector associated with the golf bag including processor in electronic communication with an antenna for detecting proximity of the one or more golf club tags and the golfer tag with the base detector. When the golfer tag is within a desired proximity of the base detector, the one or more golf club tags are inventoried to determine a number of golf club tags in proximity to the base detector. When fewer than all of the one or more golf club tags are determined to be within proximity to the base detector, the base detector generates an alert.

15 Claims, 8 Drawing Sheets

(56) References Cited

U.S. PATENT DOCUMENTS

| | | | | |
|---|---|---|---|---|
| 2006/0255918 | A1* | 11/2006 | Bernstein | G08B 21/24 340/10.6 |
| 2008/0024298 | A1* | 1/2008 | Keays | G08B 13/1427 340/568.6 |
| 2008/0218343 | A1* | 9/2008 | Lee | A63B 60/00 340/568.6 |
| 2009/0233735 | A1* | 9/2009 | Savarese | A63B 71/0669 473/407 |
| 2009/0321289 | A1* | 12/2009 | LaSala | A63B 55/00 206/315.2 |
| 2010/0265067 | A1* | 10/2010 | Keays | G08B 13/1427 340/568.6 |
| 2011/0304460 | A1* | 12/2011 | Keecheril | G06Q 10/087 340/572.1 |
| 2012/0035003 | A1* | 2/2012 | Moran | A63B 69/36 473/407 |
| 2012/0249330 | A1* | 10/2012 | Savarese | A63B 71/0669 340/568.6 |
| 2013/0144411 | A1* | 6/2013 | Savarese | G06F 17/40 700/91 |
| 2014/0313035 | A1* | 10/2014 | Holzapfel | G08B 13/1427 340/568.6 |
| 2015/0014076 | A1* | 1/2015 | Azizi | A63B 55/08 180/181 |
| 2016/0220876 | A1* | 8/2016 | Savarese | A63B 60/00 |

* cited by examiner

GOLF CLUB TRACKING SYSTEM

CROSS-REFERENCE TO RELATED APPLICATION

This application claims priority to U.S. Provisional Patent Application No. 62/426,267 for a "Club Minder" filed on Nov. 24, 2016, the contents of which are incorporated herein by reference in its entirety.

FIELD

This disclosure relates to the field of golf. More particularly, this disclosure relates to a system for tracking the removal of golf clubs from a golf bag and alerting a user when a golf club is misplaced.

BACKGROUND

Golf requires players to carry numerous clubs during a round of golf and to continuously remove and replace golf clubs as the golfer hits shots during the round. In many circumstances, the golfer may remove multiple clubs in preparation for hitting a shot to account for variances in distance. For example, a golfer may carry multiple golf clubs to hit a tee shot on a par-3 at a golf course so that the golfer may select an appropriate club based on factors such as wind and slope of the golf hole. In another example, the golfer may carry one or more wedges and putters to a green area so that the golfer may hit a chip shot and complete the hole with one or more putts.

Golfers frequently misplace golf clubs during a round of golf, such as when the golfer carries multiple clubs to hit a single shot. When a golfer misplaces a golf club, such as by leaving a golf club on a prior hole played by the golfer, the golfer must subsequently backtrack on the golf course to locate the misplaced golf club. This includes driving or walking against the flow of play on the golf course, thereby requiring the golfer to avoid subsequent groups hitting shots towards the golfer moving against the flow of play. This increases the risk of being struck by a golf ball and significantly slows a pace of play of the golfer's group and following groups.

Various attempts have been made to create systems and devices for tracking the placement of golf clubs in a golf bag. However, many of these devices fail to correctly identify when a golf club is actually misplaced, or may cause false alarms based on a golfer removing golf clubs during the bag during normal play. For example, most existing systems rely solely on the presence or absence of golf clubs relative to the golf bag without taking into consideration the presence of the golfer. These systems may cause an inadvertent alert to be created when golf clubs are removed from the golf bag, or may fail to provide an alert when a golf club is inadvertently misplaced by the golfer.

What is needed, therefore, is a system for tracking the removal of golf clubs from a golf bag and alerting a user when a golf club is misplaced.

SUMMARY

The above and other needs are met by a golf club tracking system. In a first aspect, a golf club tracking system for tracking the removal and replacement of golf clubs relative to a golf bag by a golfer includes: one or more golf club tags associated with one or more of the golf clubs; a golfer tag associated with the golfer; a base detector associated with the golf bag including processor in electronic communication with an antenna for detecting proximity of the one or more golf club tags and the golfer tag with the base detector. When the golfer tag is within a desired proximity of the base detector, the one or more golf club tags are inventoried to determine a number of golf club tags in proximity to the base detector. When fewer than all of the one or more golf club tags are determined to be within proximity to the base detector, the base detector generates an alert.

In one embodiment, when fewer than all of the one or more golf club tags are determined to be in proximity to the base detector, the base detector generates an alert after a designated wait period.

In another embodiment, the one or more golf club tags further include a transmitter for emitting a signal from the one or more golf club tags. In yet another embodiment, the one or more golf club tags include a Bluetooth® transmitter, and wherein the antenna of the base detector is configured to detect a signal from the Bluetooth® transmitter. In one embodiment, a transmission of the Bluetooth® transmitter of the one or more golf club tags includes a unique identifier associated with each of the one or more golf club tags.

In another embodiment, the generated alert includes an identity of the one or more golf club tags that are not within proximity of the base detector.

In yet another embodiment, the golfer tag further includes a transmitter for emitting a signal from the golfer tag, wherein the base detector is configured to detect the signal emitted from the golfer tag.

In one embodiment, the desired proximity of the golfer tag to the base detector is definable by a user.

In another embodiment, one of the base detector and golfer tag comprises a smartphone. In yet another embodiment, the golf club tracking system further includes a user device in communication with the base detector, the user device including a user interface operable on the user device to define one or more settings of the golf club tracking system.

In one embodiment, the alert generated by the base detector is emitted on the user device.

In a second aspect, a golf club tracking system for tracking the removal and replacement of golf clubs relative to a golf bag by a golfer includes: one or more golf club tags associated with one or more of the golf clubs; a golfer tag associated with the golfer; a base detector associated with the golf bag including processor in electronic communication with an antenna for detecting proximity of the one or more golf club tags and the golfer tag with the base detector. When the golfer tag is within a desired proximity of the base detector, the one or more golf club tags are inventoried to determine a number of golf club tags in proximity to the base detector. When fewer than all of the one or more golf club tags are determined to be within proximity to the base detector, the base detector generates an alert after a designated wait period.

In one embodiment, the one or more golf club tags further include a transmitter for emitting a signal from the one or more golf club tags.

In a third aspect, a method of tracking inventory of a plurality of golf clubs relative to a golf bag includes: providing one or more golf club tags associated with the plurality of golf clubs; providing a base detector associated with the golf bag for detecting proximity of the one or more golf club tags; providing a golfer tag associated with a golfer; detecting a presence of the golfer tag within a designated distance of the base detector associated with the golf club; performing an inventory of a number of the one or more golf club tags detected in proximity to the base detector when the golfer tag is determined to be within the designated distance of the base detector; and generating an alert when fewer than all of the one or more golf club tags associated with the plurality of golf clubs is determined to be in proximity of the base detector when the golfer tag is determined to be within the designated distance of the base detector.

In one embodiment, the method further includes generating the alert after a designated wait period when fewer than all of the one or more golf club tags is determined to be in proximity of the base detector when the golfer tag is determined to be within the designated distance of the base detector.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
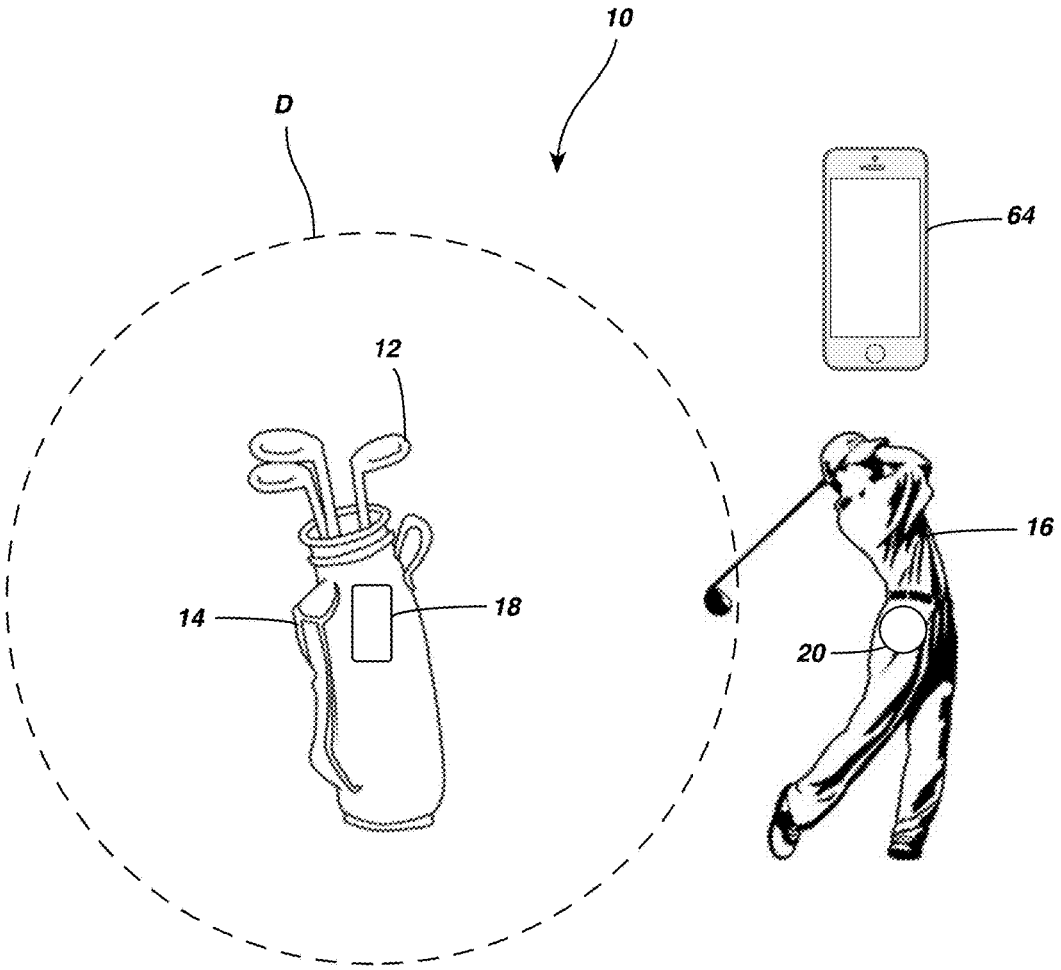
FIG. 1 shows a golf club tracking system according to one embodiment of the present disclosure.

FIG. 1 shows a basic embodiment of a golf club tracking system 10 for tracking an inventory of one or more golf clubs 12 relative to a golf bag 14. The golf club tracking system 10 allows for an inventory of the one or more golf clubs 12 to be conducted when a golfer 16 is in proximity to the golf bag 14 and alerts the golfer 16 to the potential misplacement of the one or more golf clubs 12, such as if a golf club 12 is inadvertently left behind by the golfer 16. The golf club tracking system 10 includes a base detector 18, a golfer tag 20, and one or more golf club tags 22 (FIG. 2) installed on the one or more golf clubs as described in greater detail below.

Figure 2:
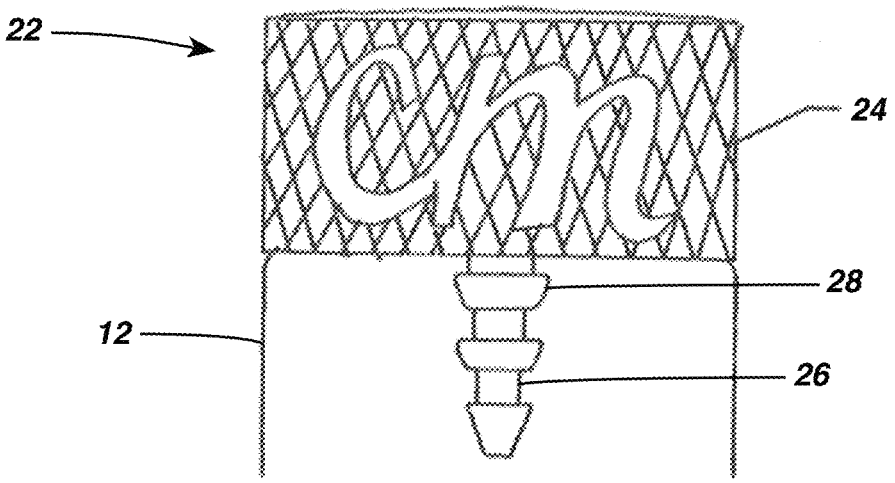
FIGS. 2 and 3 show a golf club tag according to one embodiment of the present disclosure.

Referring to FIG. 2, the one or more golf club tags 22 are associated with the one or more golf clubs 12. For example, the golf club tags 22 may be removably attached to the one or more golf clubs 12. The golf club tags 22 may include a golf club tag housing 24 and a prong 26 extending from the golf club tag housing 24. The prong 26 may include a plurality of barbs 28 for installing the golf club tags 22 into ends of the golf clubs 12 and preventing the golf club tags 22 from being inadvertently removed from the golf clubs 12. While FIG. 2 illustrates a golf club tag 22 attached to an end of the golf club 12, it is also understood that the golf club tags 22 may be otherwise attached or integrated with the golf clubs 12, such as by locating the golf club tags 22 within a shaft, grip, or other area of the golf clubs 12.

The golf club tag 22 is configured to be detected by the base detector 18 to determine whether the golf club tag 22 is within proximity to the base detector 18. The proximity is determined as a distance between the golf club tag 22 and the base detector 18, and is preferably defined as a distance such that the golf club tag 22 and associated golf club 12 are within the golf bag 14 when the golf club tag 22 is within proximity of the base detector 18, as described in greater detail below. In one embodiment, the golf club tag 22 may be one of a passive or active tag. For example, in one embodiment the golf club tag 22 is formed of a passive RFID tag that is interrogated by the base detector 18.

Figure 3:
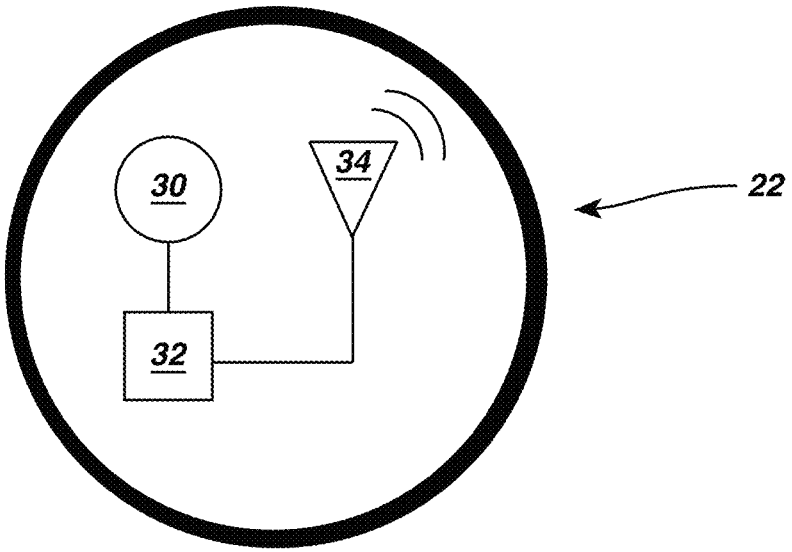

In another embodiment, as shown in FIG. 3, the golf club tag 22 is an active tag that broadcasts a signal from the golf club tag 22. The golf club tag 22 may include a power source 30, a controller 32, and a transmitter 34 in electronic communication with the controller 32. The golf club tag 22 may be configured to emit a signal, such as a Bluetooth® or Bluetooth® LE signal from the antenna of the golf club tag 22, the signal being broadcast a designated distance from the golf club tag 22 for detection by the base detector 18. The signal broadcast by the golf club tag 22 may include a unique identification code associated with the golf club tag 22 that is identifiable on the base detector 18. In one embodiment, the golf club tag 22 is an active tag that is compatible with the iBeacon protocol for broadcasting an identifier within a designated distance of the golf club tag 22.

Figure 4:
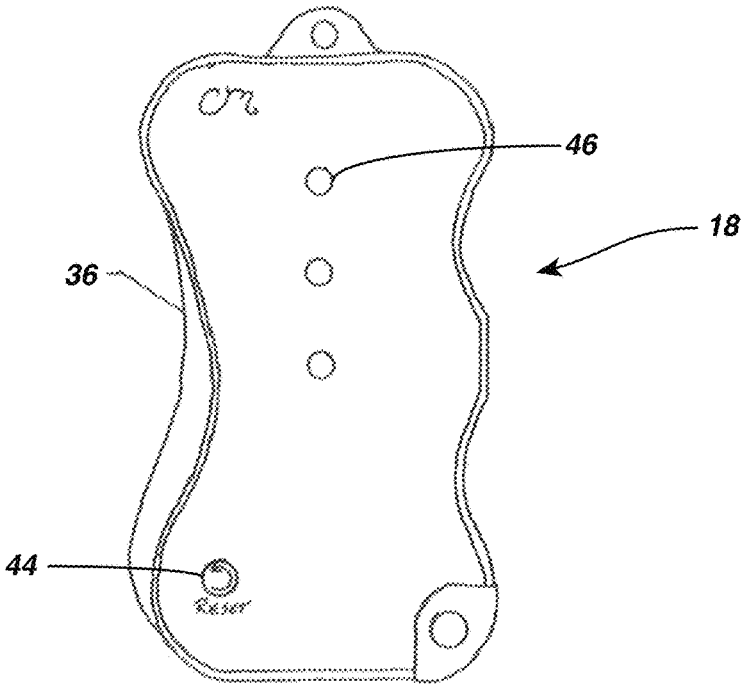
FIGS. 4 and 5 show a base detector of a golf club tracking system according to one embodiment of the present disclosure.
Figure 5:
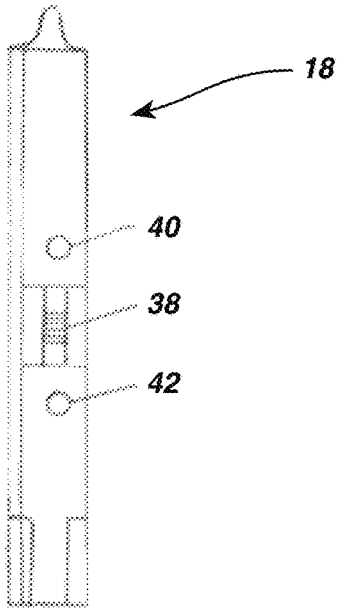

Referring again to FIG. 1, the base detector 18 is configured to detect proximity of the one or more golf club tags 22 to the base detector 18. The base detector 18 is associated with the golf bag 14, such as by attaching the base detector 18 to the golf bag 14 or by hanging the base detector 18 from the golf bag 14. Referring to FIGS. 4 and 5, the base detector 18 includes a durable housing 36 that is preferably weatherproof for use of the golf club tracking system 10 during inclement weather. The base detector 18 may include one or more indicators formed in the housing 36 including a power switch 38, a power light 40, a synchronization light 42, a reset button 44, and one or more battery indicators 46 for indicating a battery level of a power source of the one or more golf club tags 22 or base detector 18.

Figure 6:
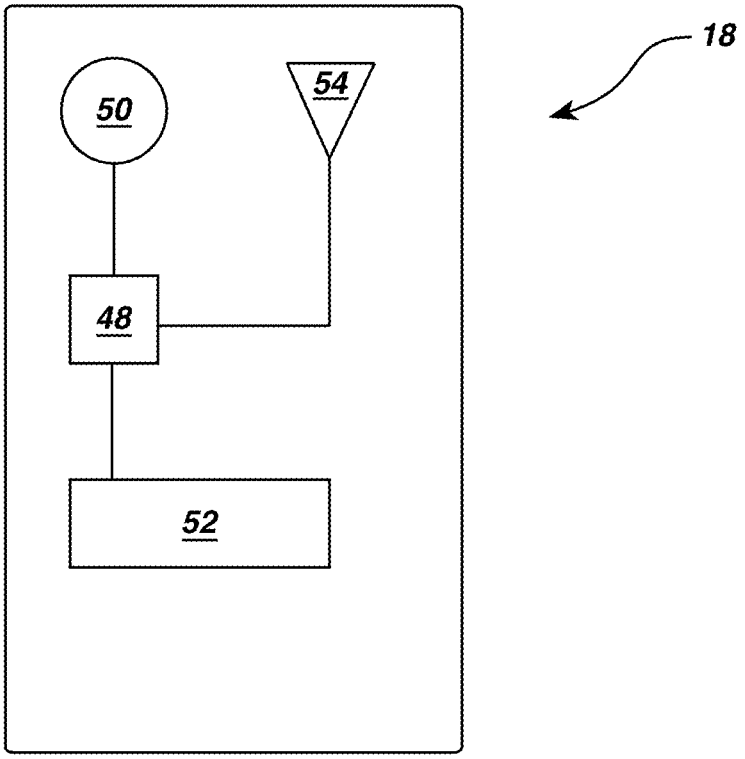
FIG. 6 shows a diagram of a base detector according to one embodiment of the present disclosure.

Referring now to FIG. 6, the base detector 18 includes a controller 48, a power source 50 in electronic communication with the controller 48, one or more transitory and nontransitory computer readable storage mediums 52 in electronic communication with the controller 48, and an antenna 54 in electronic communication with the controller 48. Components of the base detector 18 are configured to detect a transmission from the golf club tags 22 and to determine whether the golf club tags 22 are in proximity to the base detector 18. Further, the base detector 18 is configured to detect whether the golfer tag 20 is within a designated distance of the base detector 18, as described in greater detail below. While FIG. 6 illustrates an exemplary arrangement of components suitable for the base detector 18, it is also understood that the base detector 18 may be formed of various other components for detecting transmissions or otherwise interrogating the golf club tags 22 and golfer tag 20.

Figure 7:
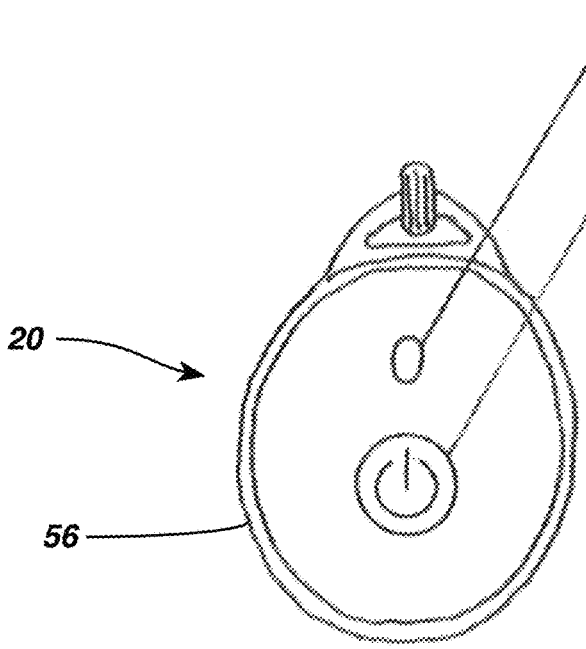
FIGS. 7-9 show a golfer tag according to one embodiment of the present disclosure.
Figure 8:
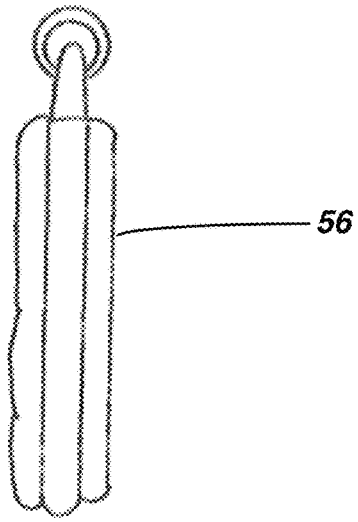
Figure 9:
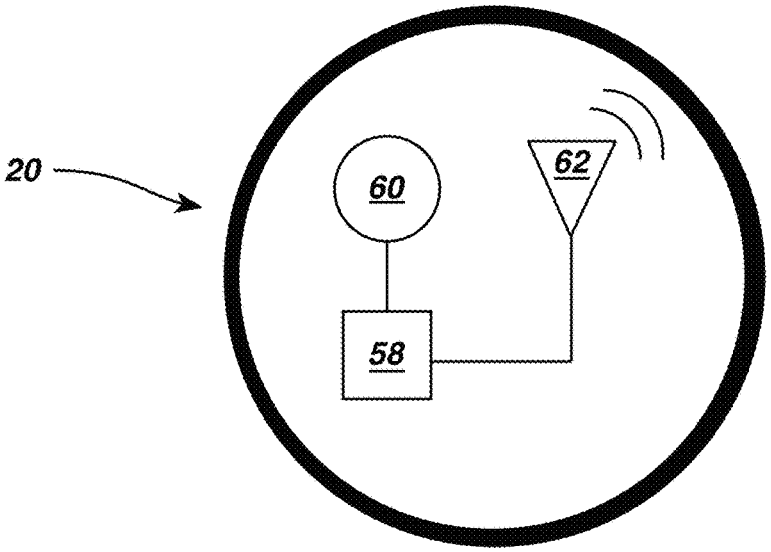

Referring to FIGS. 7-9, the golfer tag 20 includes a housing 56 containing components of the golfer tag 20. The golfer tag 20 also preferably includes a power button 55 and an LED indicator 57 to indicate a status of the golfer tag 20, such as battery life or connection status. In one embodiment, the golfer tag 20 is similar in construction to the one or more golf club tags 22 and includes a controller 58 in electronic communication with a power source 60 and a transmitter 62. The golfer tag 20 preferably emits a transmission in a known protocol, such as Bluetooth® or other similar communication protocols, that is detected by the base detector 18. In one embodiment, the golfer tag 20 is a passive tag such as an RFID or other like tag. The golfer tag 20 may emit a unique identification code that is detectable by the base detector 18 such that the golfer tag 20 is recognized as associated with the golfer 16.

Figure 10:
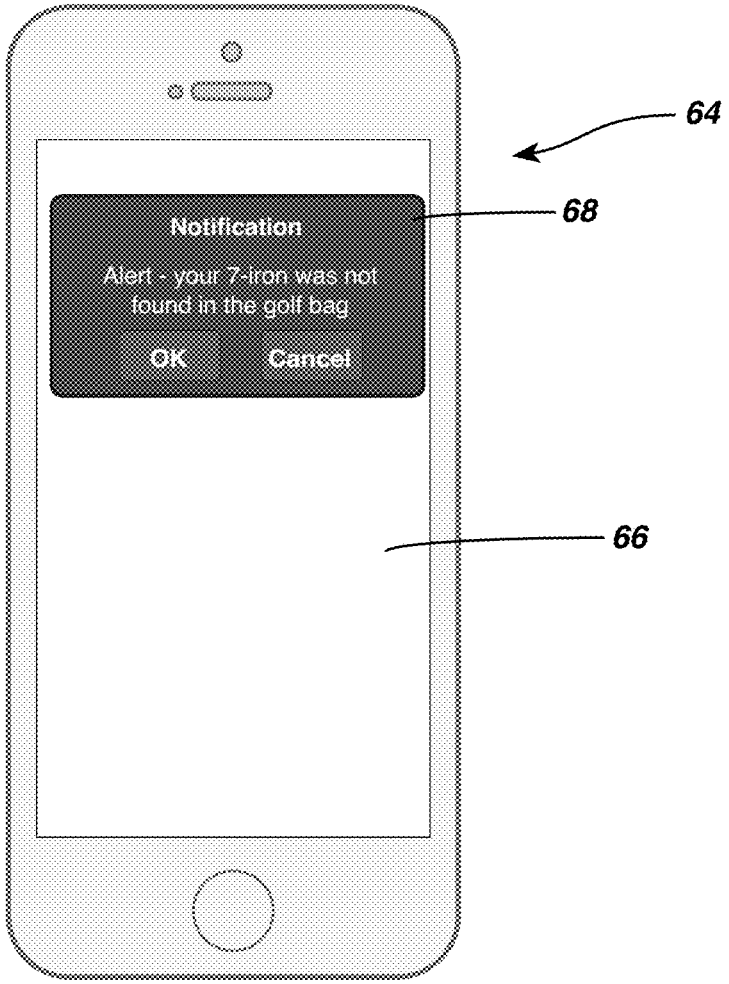
FIG. 10 shows a user device and display according to one embodiment of the present disclosure.

In one embodiment, a user device 64 is in communication with the base detector 18, such as via a Bluetooth® or other suitable wireless connection. A suitable user device 64 could include, for example, a smartphone or other similar device, as illustrated in FIG. 10. The user device 64 includes a display 66 and a user interface that is operable on the user device 64. When the base detector 18 generates an alert, a notification 68 may be displayed on the display 66 of the user device 64, and may further include additional alerting of the user such as by vibration of the user device 64 or by emitting an audible alert. In one embodiment, the user device 64 may be suitable for functioning as the base detector 18 or the golfer tag 20 by utilizing built-in antenna and transmitter functions of the user device 64, such as by utilizing a protocol such as iBeacon or Bluetooth® LE. The golfer 16 may enter information and settings via the user device 64, such as by assigning the one or more golf club tags 22 to one or more of the golf clubs 12, and by designating a desired distance of the golfer 16 to the golf bag 14 for taking an inventory of the one or more golf clubs 12 as described in greater detail below.

Figure 11:
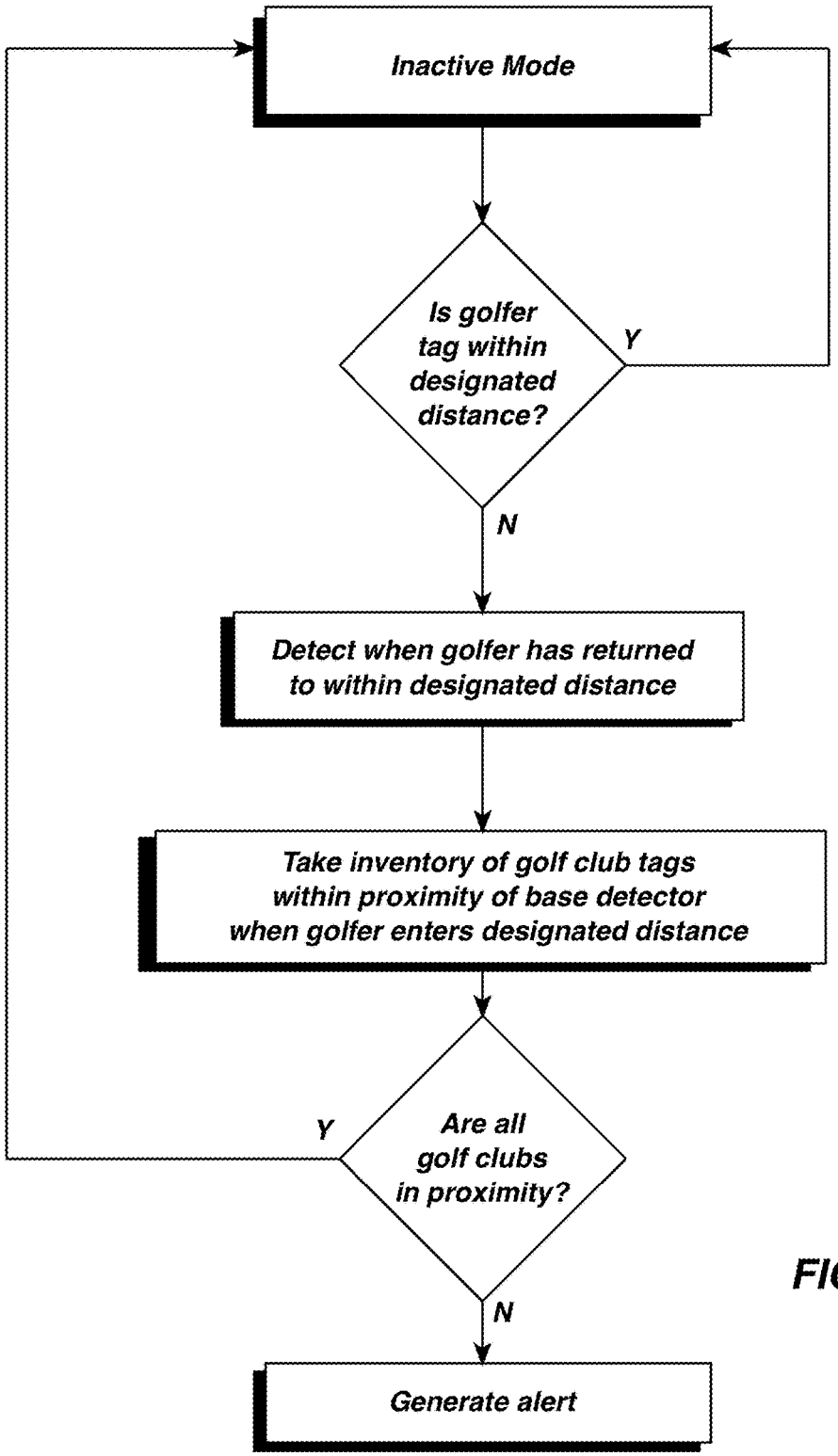
FIG. 11 shows a flow chart of a golf club tracking system according to one embodiment of the present disclosure.

In operation, the one or more golf club tags 22, golfer tag 20, and base detector 18 communicate to generate an alert when one or more of the golf clubs 12 are not found to be located in the golf bag 14. Referring to FIG. 11, when all of the golf clubs 12 and associated golf club tags 22 are located in proximity to the base detector 18 and therefore in the golf bag 14, the base detector 18 preferably remains in an inactive mode wherein no alert is generated. When the golfer 16 remains within a designated distance D (FIG. 1) of the base detector 18, the golf club tracking system 10 remains in an inactive mode wherein no alert is generated. When the golfer 16 is determined to be outside of the designated distance D of the golf bag 14, the golf club tracking system 10 may enter a mode wherein the base detector 18 awaits detection of the golfer 16 and associated golfer tag 20 within the designated distance D of the golf bag 14 and associated base detector 18. When the golfer 14 is detected as being within the designated distance D of the base detector 18, the base detector 18 will conduct an inventory of golf club tags 22 that are in proximity to the base detector 18 and associated golf bag 14. If all golf club tags 22 and associated golf clubs 12 are determined to be in proximity to the golf bag 14, the golf club tracking system 10 re-enters an inactive mode and no alert is generated. If one or more of the golf club tags 22 are not found to be in proximity to the golf bag 14, the base detector 18 may generate an alert that indicates one or more golf clubs 12 have not returned with the golfer 16.

Figure 12:
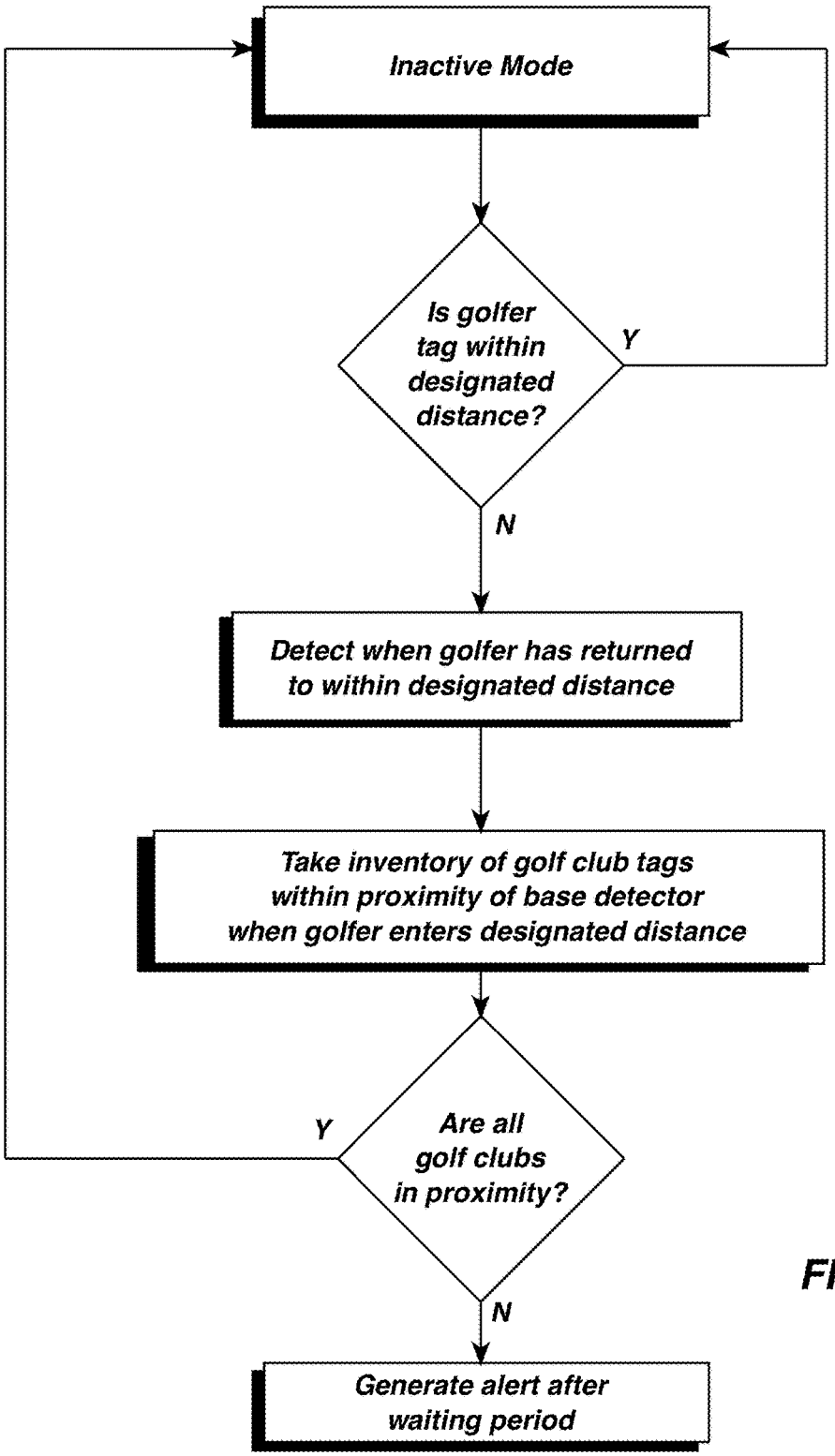
FIG. 12 shows a flow chart of a golf club tracking system according to another embodiment of the present disclosure.

Referring to FIG. 12, in one embodiment the base detector 18 will wait for a designated wait period before activating an alarm. For example, the wait period may be defined as a period of 15 seconds, wherein when the base detector 18 determines that one or more of the golf clubs 12 are missing, the base detector 18 will wait 15 seconds before generating an alert to the golfer 16.

While the above describes embodiments of the golf club tracking system 10, it is also understood that various alternative configurations may be provided to detect whether all golf clubs 12 are in proximity to the base detector 18. For example, the base detector 18 may determine whether the golfer 16 is within the designated distance D based on a strength of a transmission emitted from the golfer tag 20. Alternatively, the golfer tag 20 may be configured to emit a transmission within a designated distance, such as approximately 6 feet, and the base detector will determine that the golfer 16 is within the designated distance D when the base detector detects any transmission from the golfer tag 20.

In additional embodiments, unique identification codes of the golf club tags 22 may be used to identify particular clubs associated with the golf club tags 22. For example, if an identification code is associated with a golf club tag 22 attached to a 7-iron, when an alert is generated the alert may include information indicating which club is missing from the golf bag 14. Similarly, additional alerts may be generated, such as when the base detector 18 detects more than a desired number of clubs in the golf bag 14. For example, if a player has 15 clubs in the golf bag 14, an alert may be generated indicating that the golfer 16 has more than an allowable number of clubs in the golf bag 14.

The golf club tracking system 10 of the present disclosure advantageously tracks a number of golf clubs in a player's golf bag and warns the player when a golf club may be inadvertently misplaced or left behind during a round of golf. Because the system only generates an alert after the golfer has moved away from the golf bag and returned, the golf club tracking system 10 is able to more accurately identify when a golf club is missing and significantly reduces a number of false alarms by the system. Further, by utilizing a waiting period, the golf club tracking system 10 provides enough time for a golfer to place any golf clubs into the golf bag before an alert is generated, thereby further reducing a likelihood of an inadvertent alert generated by the system. Finally, the golf club tracking system 10 of the present disclosure is easily installed onto existing golf clubs and golf bags within requiring modification of the golf clubs or golf bags, and further is easily removed or moved to different golf clubs if desired by the golfer.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A golf club tracking system for tracking the removal and replacement of golf clubs relative to a golf bag by a golfer, the golf club tracking system comprising:

one or more golf club tags associated with one or more of the golf clubs such that the one or more golf club tags are located on the golf clubs and including a golf club tag housing and a golf club transmitter located within the golf club tag housing;

a golfer tag associated with the golfer such that the golfer tag is located on the golfer and including a golfer tag housing and a golfer transmitter located within the golfer tag housing;

a base detector associated with the golf bag including a processor in electronic communication with an antenna for detecting a signal of at least one of the golf club transmitters and the golfer transmitter to determine proximity of the one or more golf club tags and the golfer tag with the base detector;

wherein when the golfer tag is determined to be within proximity of the base detector based a signal of the golfer transmitter detected on the base detector, the one or more golf club tags are inventoried by determining a number of golf club tags in proximity to the base detector based on signals from the golf club transmitters of the one or more golf club tags being detected on the antenna of the base detector to indicate that the one or more golf clubs are therefore within the golf bag; and wherein when fewer than all of the one or more golf club tags are detected by the base detector when the golfer tag is determined to be within proximity to the base detector, one of the base detector and golfer tag generates an alert.

2. The golf club tracking system of claim 1, wherein when fewer than all of the one or more golf club tags are detected when the golfer tag is in proximity to the base detector, the base detector generates an alert after a designated wait period.

3. The golf club tracking system of claim 1, wherein the one or more golf club tags further comprise a transmitter for emitting a signal from the one or more golf club tags.

4. The golf club tracking system of claim 3, wherein the one or more golf club tags comprise a Bluetooth® transmitter, and wherein the antenna of the base detector is configured to detect a signal from the Bluetooth® transmitter.

5. The golf club tracking system of claim 4, wherein a transmission of the Bluetooth® transmitter of the one or more golf club tags includes a unique identifier associated with each of the one or more golf club tags.

6. The golf club tracking system of claim 5, wherein the generated alert includes an identity of the one or more golf club tags that are not within proximity of the base detector.

7. The golf club tracking system of claim 1, the golfer tag further comprising a transmitter for emitting a signal from the golfer tag, wherein the base detector is configured to detect the signal emitted from the golfer tag.

8. The golf club tracking system of claim 1, wherein the desired proximity of the golfer tag to the base detector is definable by a user.

9. The golf club tracking system of claim 1, wherein one of the base detector and golfer tag comprises a smartphone.

10. The golf club tracking system of claim 1, further comprising a user device in communication with the base detector, the user device including a user interface operable on the user device to define one or more settings of the golf club tracking system.

11. The golf club tracking system of claim 10, wherein the alert generated by the base detector is emitted on the user device.

12. A golf club tracking system for tracking the removal and replacement of golf clubs relative to a golf bag by a golfer, the golf club tracking system comprising:

one or more golf club tags associated with one or more of the golf clubs such that the one or more golf club tags are located on the golf clubs and including a golf club tag housing and a golf club transmitter located within the golf club tag housing;

a golfer tag associated with the golfer such that the golfer tag is located on the golfer and including a golfer tag housing and a golfer transmitter located within the golfer tag housing;

a base detector associated with the golf bag including a processor in electronic communication with an antenna for detecting a signal of at least one of the golf club transmitters and the golfer transmitter to determine proximity of the one or more golf club tags and the golfer tag with the base detector;

wherein when the golfer tag is determined to be within proximity of the base detector based a signal of the golfer transmitter detected on the base detector, the one or more golf club tags are inventoried by determining a number of golf club tags in proximity to the base detector based on signals from the golf club transmitters of the one or more golf club tags being detected on the antenna of the base detector to indicate that the one or more golf clubs are therefore within the golf bag; and wherein when fewer than all of the one or more golf club tags are detected by the base detector when the golfer tag is determined to be within proximity to the base detector, one of the base detector and golfer tag generates an alert after a predetermined wait period.

13. The golf club tracking system of claim 12, wherein the one or more golf club tags further comprise a transmitter for emitting a signal from the one or more golf club tags.

14. A method of tracking inventory of a plurality of golf clubs relative to a golf bag, the method comprising:

providing one or more golf club tags associated with the plurality of golf clubs and including a golf club tag housing a golf club transmitter located within the golf club tag housing;

providing a base detector associated with the golf bag including a processor in electronic communication with an antenna for detecting a signal of at least one of the golf club transmitters and the golfer transmitter for detecting proximity of the one or more golf club tags;

providing a golfer tag associated with a golfer such that the golfer tag is located on the golfer and including a golfer tag housing and a golfer transmitter located within the golfer tag housing;

detecting a presence of the golfer tag within a proximity of the base detector associated with the golf club based on a detected signal emitted from the golfer transmitter of the golfer tag;

performing an inventory of a number of the one or more golf club tags detected in proximity to the base detector and therefore within the golf bag when the golfer tag is determined to be within the designated distance of the base detector;

generating an alert when fewer than all of the one or more golf club tags associated with the plurality of golf clubs detected when the golfer tag is in proximity of the base detector.

15. The method of tracking inventory of a plurality of golf clubs of claim 14, further comprising generating the alert after a designated wait period when fewer than all of the one or more golf club tags is determined to be in proximity of the base detector when the golfer tag is determined to be within the designated distance of the base detector.

* * * * *